US006015352A

United States Patent [19]

Leopold et al.

[11] Patent Number: 6,015,352

[45] Date of Patent: Jan. 18, 2000

[54] GOLF TRAINING DEVICE FOR CHIP SHOTS

[75] Inventors: Douglas Leopold, Clearwater; John T. D'Ambra, Gulfport, both of Fla.

[73] Assignee: D.J. Damapold, Inc., Clearwater, Fla.

[21] Appl. No.: 09/001,346

[22] Filed: Dec. 31, 1997

[51] Int. Cl.[7] ..... A63B 69/36

[52] U.S. Cl. ..... 473/172; 473/174; 473/180

[58] Field of Search ..... 434/252; 473/131, 473/157, 150, 172, 174, 185, 195, 196, 207, 278, 280, 158, 167, 168, 169, 170, 176, 186, 192, 153, 159, 279, 261, 264, 265, 258, 218

[56] References Cited

U.S. PATENT DOCUMENTS

| | | | |
|---|---|---|---|
| 3,604,711 | 9/1971 | Hansburg | 273/DIG. 21 |
| 4,017,084 | 4/1977 | Jeffery | 473/162 |
| 5,257,808 | 11/1993 | Mueller et al. | 473/174 |
| 5,624,326 | 4/1997 | Hohl et al. | 473/176 |

*Primary Examiner*—Mark S. Graham
*Assistant Examiner*—John M. Hotaling
*Attorney, Agent, or Firm*—Ronald E. Smith

[57] ABSTRACT

An apparatus for practicing chip shots in the game of golf includes a base member that is secured to the ground by a stake. A pair of reels are rotatably mounted on the base member and an elongate flexible cord is wound about each reel. A preselected amount of each cord is unwound from its reel and extended at a preselected angle relative to the base member to a remote target area defined by an annular ring of predetermined diameter. A hook is secured to the free end of each cord, and the hook is detachably connected to an upright stake positioned within the preselected target area. Chip shots are practiced by hitting a special, light weight ball along a path of travel denoted by the cords. In a preferred method, the special ball is placed in the vicinity of a preselected target area and hit toward the base member along a first path of travel denoted by a cord means. After the special ball arrives in the vicinity of the base member, the next series of shots is directed from the base member to the next remote target along a path of travel denoted by a second cord means. Such sequence of shots simulates play on a fairway having a dogleg defined by the angular relation of the target members with respect to the base member and the length of each cord. A relatively small space is required because the special ball does not travel far when struck. Handles on the reel members facilitate rewinding the cords when the practice session has ended.

8 Claims, 6 Drawing Sheets

GOLF TRAINING DEVICE FOR CHIP SHOTS

BACKGROUND OF THE INVENTION

1. Field of the Invention

This invention relates, generally, to training devices used by golfers to improve their game. More particularly, it relates to an apparatus that helps golfers practice middle distance shots known as chip shots.

2. Description of the Prior Art

Training devices that help golfers improve their putting game include the structures disclosed in U.S. Pat. Nos. 4,017,084 to Jeffery, 3,604,711 to Hansburg, 4,278,257 to Garcia et. al., 5,624,326 to Hohl et. al., and numerous others.

Thus, it is clear that the art that includes training devices that help golfers improve their putting game is well-developed. However, the art of training devices that help golfers improve their chip shots is much less developed. Chip shots travel relatively long distances, and that fact perhaps explains why putting training devices have proliferated whereas chip shot training devices have not.

The art clearly has a need for a chip shot training device. However, the device should not require its user to have access to golf course-size lots. The ideal device would serve as a chip shot training device that could be used in areas or lots that are substantially smaller than a golf course fairway. The device should be small, lightweight, and easily hand-carried.

Moreover, the device should be interesting and fun to use. It should allow the users thereof to practice chip shots of widely varying distances. Specifically, it should help them improve their aim over varying distances.

However, in view of the art considered as a whole at the time the present invention was made, it was not obvious to those of ordinary skill in this art how the needed device could be provided.

SUMMARY OF THE INVENTION

The longstanding but heretofore unfulfilled need for an apparatus that overcomes the limitations of the prior art is now met by a new, useful, and nonobvious invention. The present invention is an apparatus for practicing chip shots in the game of golf. It includes a base member of predetermined geometrical configuration, mounting means for securing the base member to a ground surface, at least one reel means rotatably mounted to the base member, an elongate length of cord wound about each of said at least one reel means, at least one remote target means, there being one target means associated with each cord. Each target means circumscribes a preselected target area; a holding means is provided for holding a free end of each cord at a preselected location within a preselected target area circumscribed by the remote target means. A golfer practices chip shots by positioning a golf ball within the preselected target area and hitting the golf ball toward the base member along a path of travel denoted by the cord.

Thus, in the preferred embodiment that includes a pair of reel members positioned at opposite ends of the base member and a pair of remote targets, a first series of shots begins at a first target area and concludes in the vicinity of the base member, and a second series of shots begins at the base member and concludes when the ball arrives within the second target area. Significantly, shots are directed by the golfer along a path of travel defined by the elongate cords, and shots that land away from said cords by a distance that exceeds a predetermined distance result in a one stroke penalty.

In a simplified embodiment of the invention that includes a single cord and a single target, the golfer may begin a series of chip shots at the target and aim for the base member along the path of travel defined by the single cord, or the series of shots may begin at the base member and end at the target. The preferred embodiment includes two targets, two reels and two cords, however, so that a golf course fairway having a dogleg is defined by the path of travel denoted by the pair of cords.

It is a primary object of this invention to provide a golf training device that enables golfers to improve their ability to hit good chip shots.

A more specific object is to provide a device that trains golfers to hit chip shots of varying distances with a high level of accuracy.

Another object is to provide such a device in a form such that its use does not require access to large plots of vacant land.

These and other important objects, features, and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
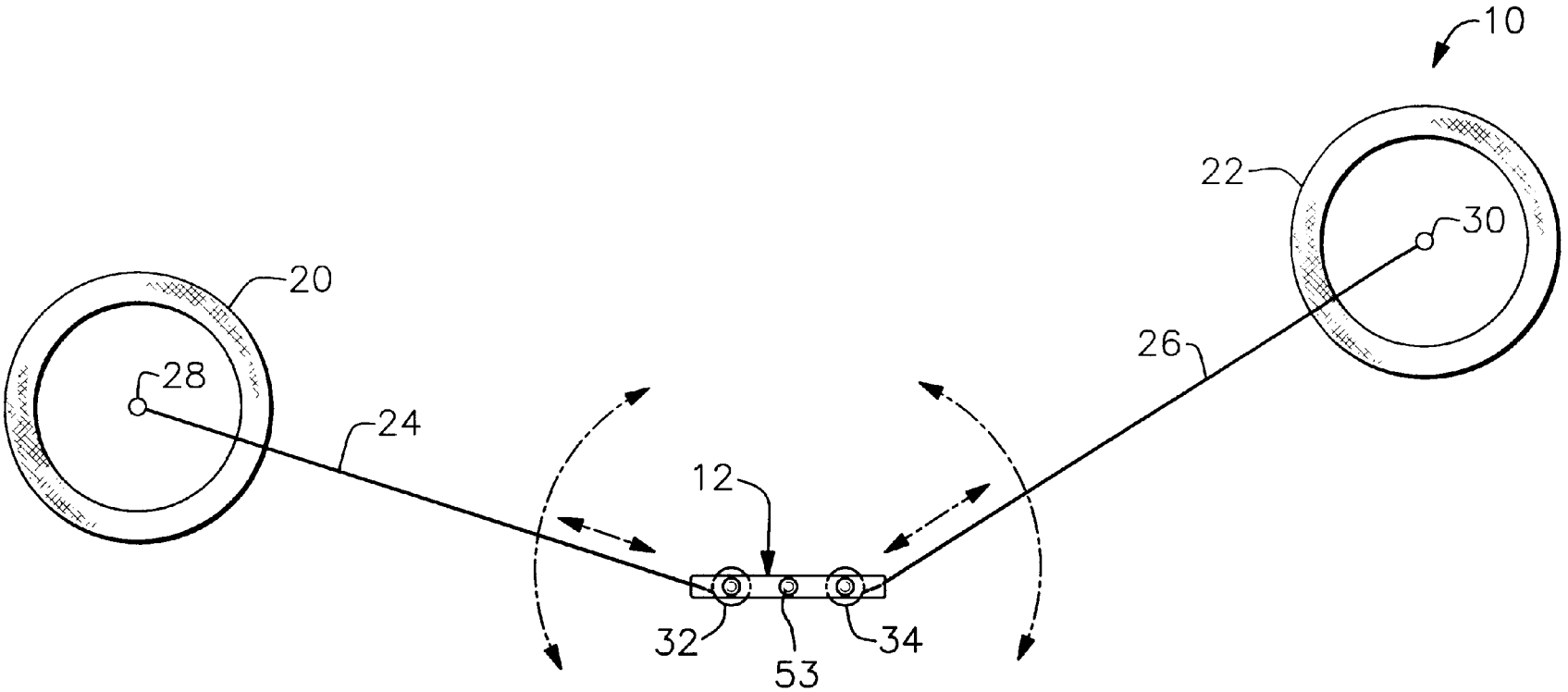
FIG. 1 is a plan view of the novel device when deployed in a first particular configuration.

Referring now to FIGS. 1–4, it will there be seen that an exemplary embodiment of the invention is denoted as a whole by the reference numeral 10.

Figure 7:
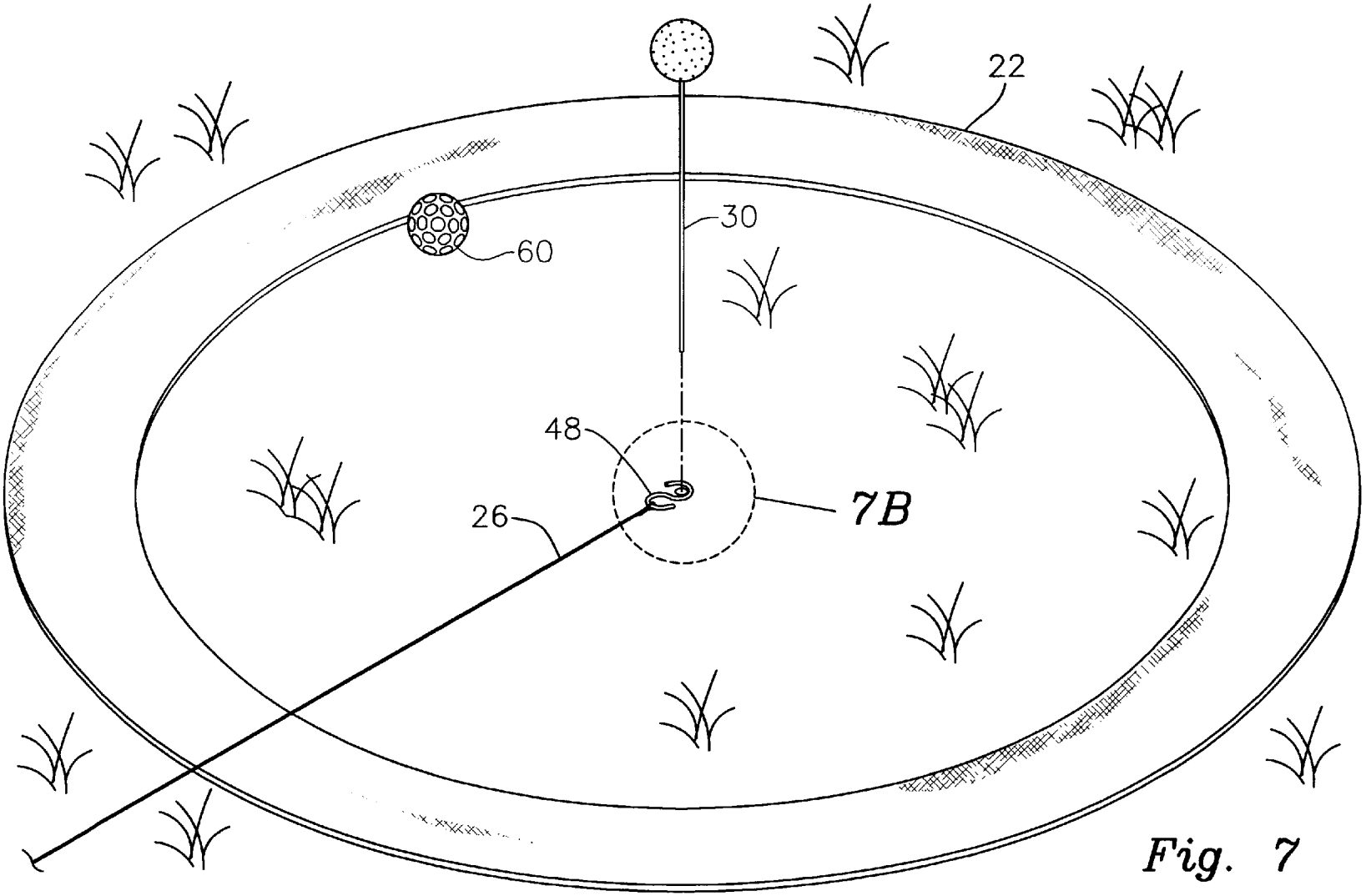
FIG. 7 is a perspective view of the target means of the novel device and further includes a perspective view of the novel golf ball of the type used in conjunction with the novel device.

Device 10 includes a rigid base 12 that is centrally apertured as at 14 (FIGS. 3 and 4) to receive an upright or upstanding stake means 16 therethrough to secure it to a support surface such as the ground 18, in vertically spaced relation thereto, i.e., base 12 does not contact ground 18. The connection between the uppermost end of stake means 16 and central aperture 14 may be a press fit or other suitable connection. A pair of circular target members, denoted 20, 22, (FIGS. 1 and 2) are respectively positioned remote from base 12 at any preselected distance, i.e., the distances from base 12 need not be equal. The target members may be of any predetermined geometrical configuration, i.e., they need not be circular as depicted. The target members are preferably formed of a flat, flexible piece of material that may have one side thereof covered with an artificial turf. An elongate, preferably brightly colored cord 24, 26, is extended from each end of base 12 to the center of each target 20, 22 and suitable holding means are employed to engage the respective remote free ends of said cords to stakes 28, 30 which are driven into the ground at the center of targets 20, 22, respectively. As depicted in FIG. 7, a ball surmounts each stake 28, 30; the ball provides a handle function that facilitates shoving a stake into the ground.

Figure 3:
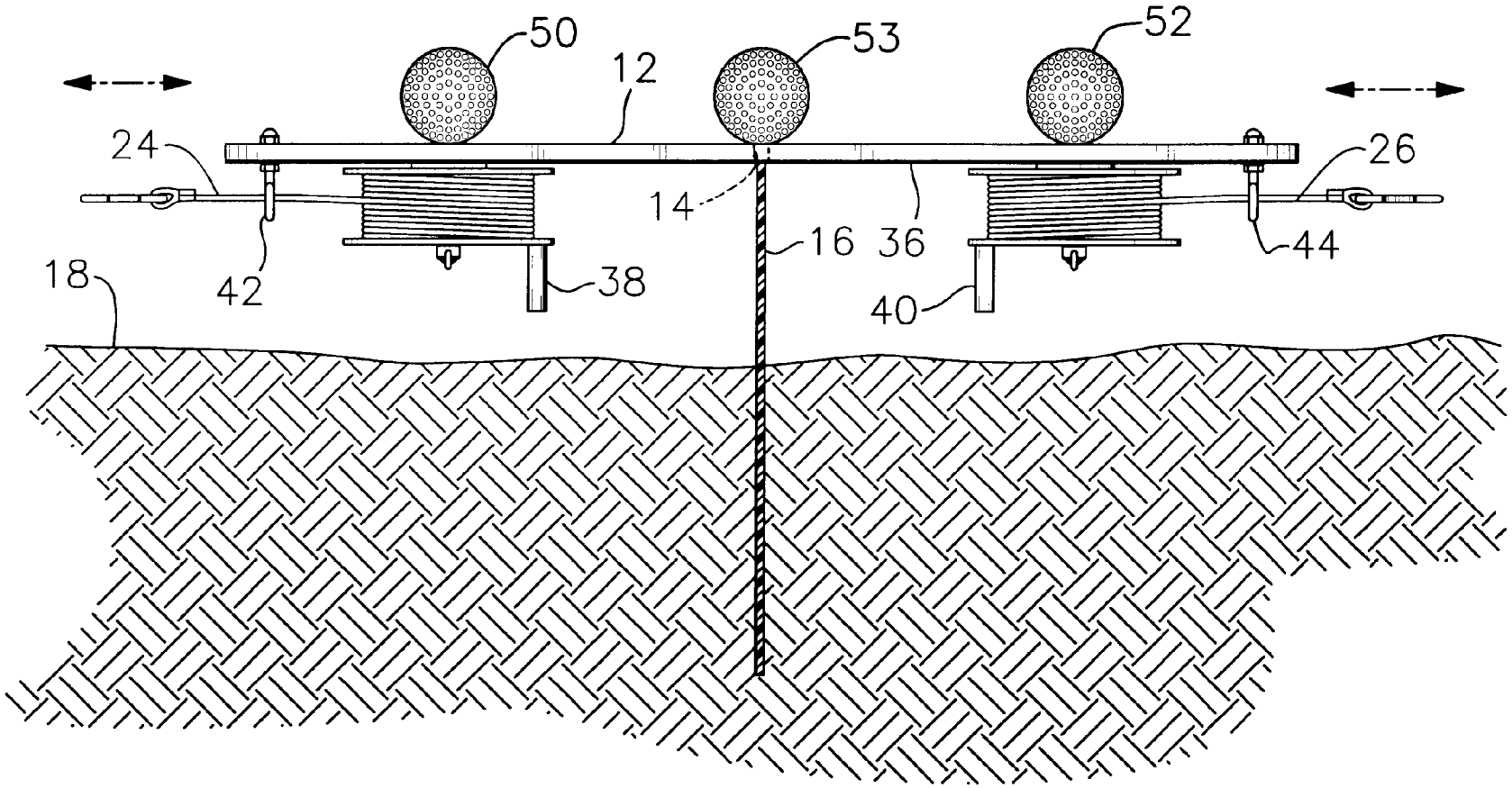
FIG. 3 is a side elevational view of the base of the novel structure when a part thereof is inserted into the ground.
Figure 4:
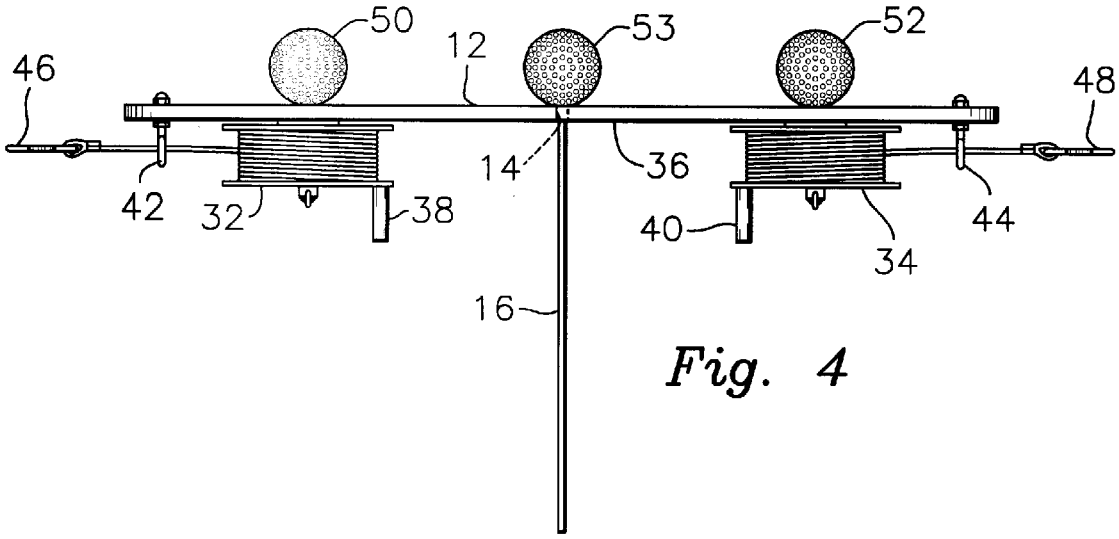
FIG. 4 is a side view like that of FIG. 3, but not depicting the device attached to the ground.

As best understood in connection with FIGS. 3 and 4, cords 24, 26 are stored on reel members 32, 34, respectively, which are rotatably mounted on a bottom wall 36 of base 12. A handle means 38, 40 depends from reel 32, 34, respectively, to facilitate re-winding of cords 24, 26 onto their respective reels when a chip shot training session is ended.

Figure 5:
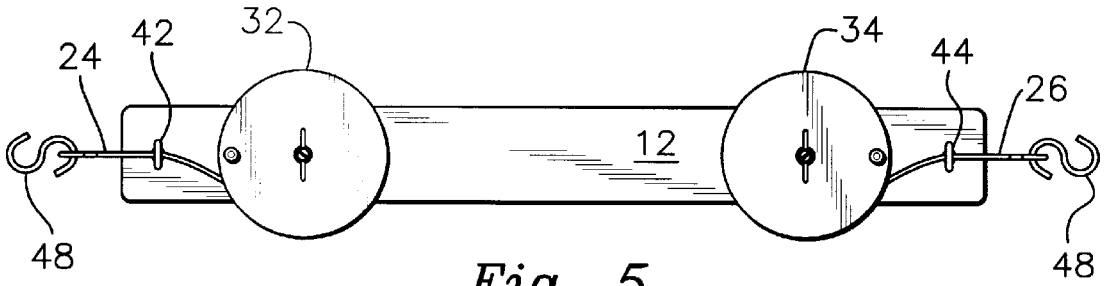
FIG. 5 is a bottom plan view of the base.
Figure 6:
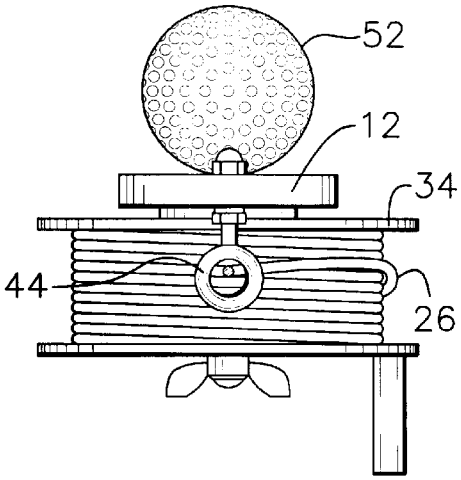
FIG. 6 is an end view of said base.

As best understood in connection with FIGS. 5 and 6, each cord 24, 26 extends through an eye hook 42, 44, respectively, or similar guide means; said eye hooks are mounted on opposite ends of said base 12, in depending relation thereto, in close proximity to their associated reel, on an outboard side thereof.

Figure 4A:
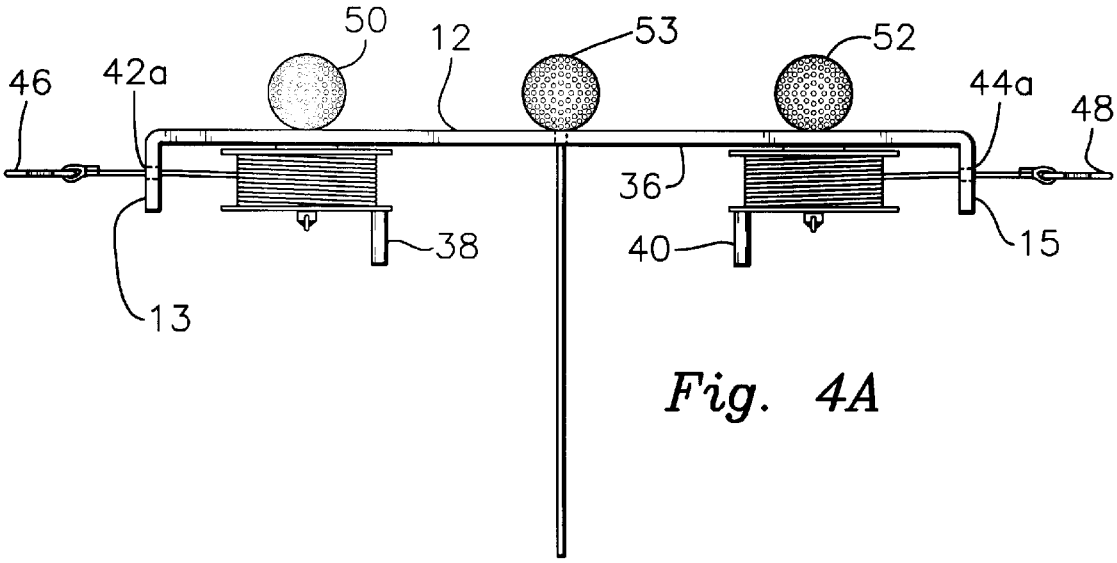
FIG. 4A is a side view of an alternative embodiment.
Figure 6A:
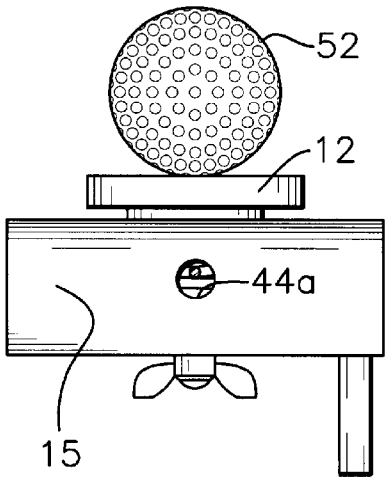
FIG. 6A is an end view of the alternative embodiment of FIG. 4A.

An alternative embodiment, which eliminates the need for eye hooks 42, 44 and their related mounting nuts and bolts, is depicted in FIGS. 4A and 6A. In this alternative embodiment, a ninety degree bend is formed in base 12 near each opposite end to create bent parts 13, 15 and a central aperture 42*a*, 44*a* that performs the function of an eye hook is formed in each bent part 13, 15, respectively, to serve as the guide means for cords 24, 26, respectively.

An "S" hook 46, 48, or equivalent part, is secured to the free end of each cord 24, 26; such hooks releasably engage stakes 28, 30 which are centered with respect to targets 20, 22, as aforesaid.

Golf balls 50, 52 are decorative. They are mounted on the same axle as their associated reel members, so that when the cords are played out or reeled in, the golf balls rotate about the vertical axis defined by said axle. Golf ball 53 is also decorative.

Figure 2:
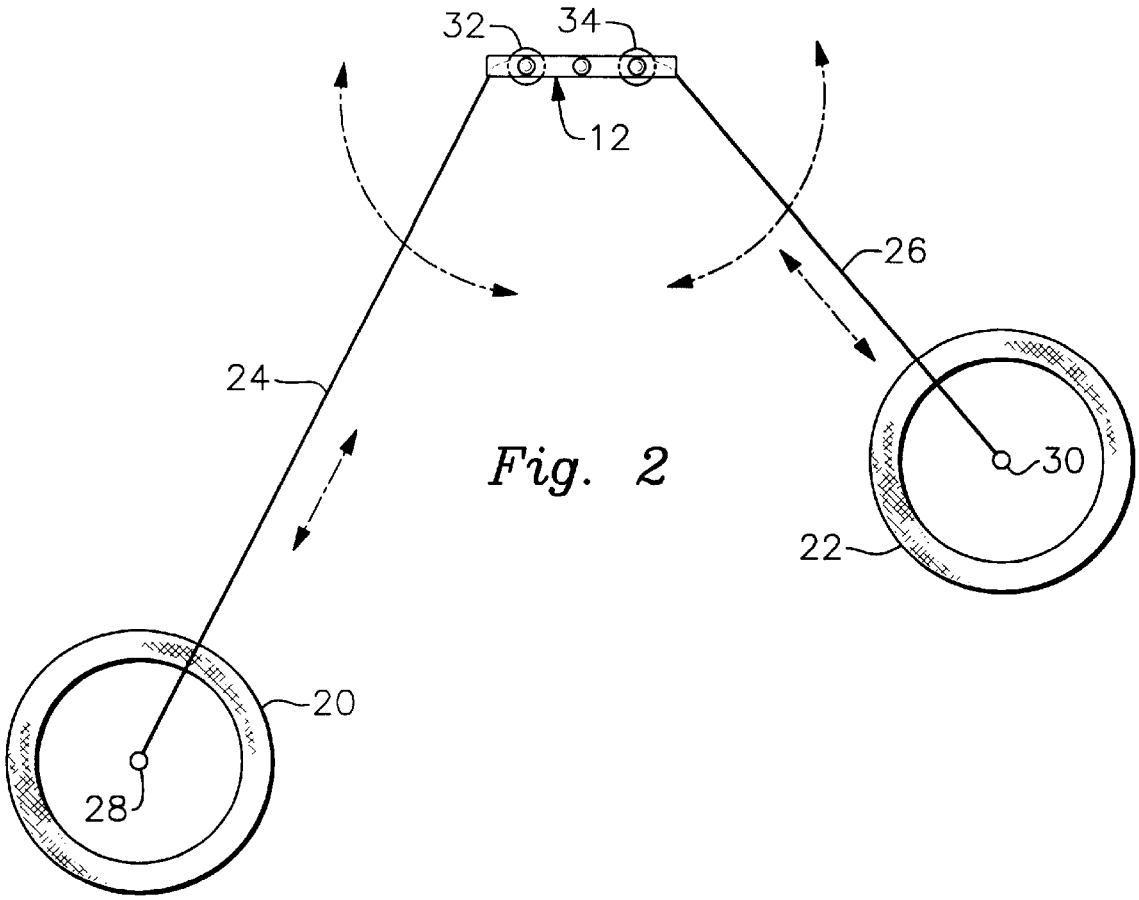
FIG. 2 is a plan view thereof when deployed in a second particular configuration.
Figure 7B:
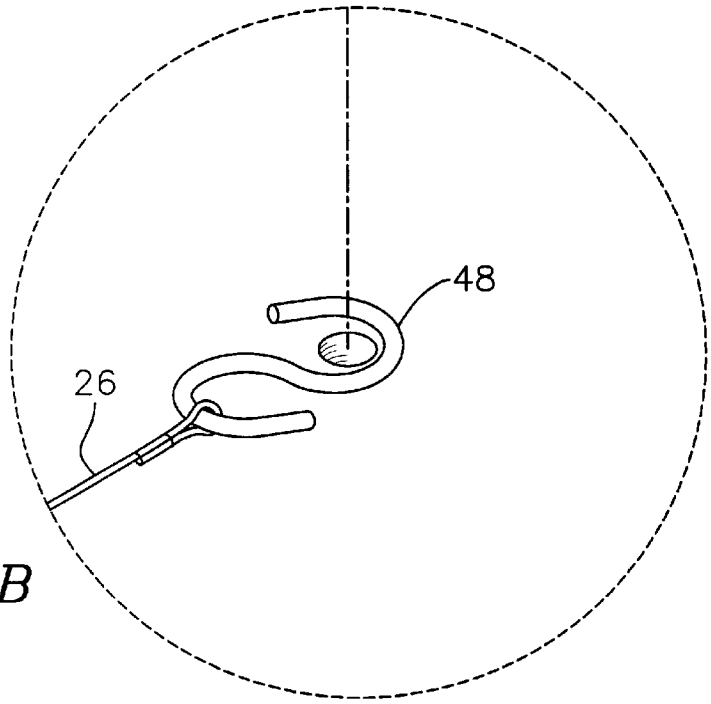
FIG. 7B is a detailed view of the area denoted 7B in FIG. 7.

FIGS. 1 and 2 provide two exemplary configurations of the novel structure 10. As indicated by the arcuate double-headed directional arrows, the angle of each cord 24, 26 with respect to base 12 can be any preselected angle, and as indicated by the straight double-headed arrows, the length of each cord is variable.

Device 10 is used by placing a preselected ball 60, depicted in FIG. 7, in the vicinity of a preselected target; in this example, the ball is placed in the area circumscribed by target 22, but the ball may also be placed outside of said circumscribed area as long as it is in the general vicinity of a preselected target. The ball is hit along cord 26 with a club, selected by the golfer, of the type used to hit chip shots, i.e., the decision of whether to use a 5 iron or a 7 iron, or the like, is made by the golfer and is based upon the apparent distance to be covered and other factors. The ball must be hit so that it lands within six feet, or some other prescribed distance, of the cord. When the ball reaches base 12, the other target 20 becomes the next target. A shot that lands more than six feet away from a cord results in a one stroke penalty.

In other words, play begins at one target area 20 or 22 and concludes at the opposite target area, with the first shot or shots being directed at base 12 and subsequent shots being aimed at the other target. This simulates playing various dogleg-like fairways of differing angles and lengths.

This invention may be simplified by providing a single reel and a single target. In that case, a golfer could still practice chip shots from the target area to the base, or vice versa, but no fairway having a dogleg would then be simulated.

Ball 60 may be a Whiffle (trademark) ball, i.e., a ball having a hollow plastic construction with a large plurality of holes formed therein so that it does not travel great distances even when struck hard. Alternatively, it may also be a ball formed of a solid foam. Other balls that carry a relatively short distance, when compared to a golf ball, when struck by a comparable force, are within the scope of this invention. The precise type of ball is not critical, as long as the ball travels a shorter distance than a golf ball when hit with a comparable force. In this way, a seventy five yard distance from target 20 or 22 to base 12 is the equivalent of a much longer distance. Since a Whiffle ball or a solid foam ball slices and hooks in substantially the same way as a regular golf ball if hit incorrectly, use of such a ball teaches the golfer how to hit a ball correctly.

Par is set for each configuration of targets and players may record the configuration and their scores so that they can see their progress as they continue to use device 10.

When a training session is over, it is a simple matter to pull up stakes 28, 30, pick up targets 20, 22, reel in cords 24, 26, and pull up stake 16 to detach base 12 from the ground.

It will thus be seen that the objects set forth above, and those made apparent from the foregoing description, are efficiently attained and since certain changes may be made in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An apparatus for practicing chip shots in the game of golf, comprising:

a base member of predetermined geometric configuration;

mounting means for securing said base member to a ground surface;

a first reel means and a second reel means rotatably mounted to said base member;

a first cord and a second cord, each having an elongate length, said first cord being wound about said first reel means and said second cord being wound around said second reel means;

a first remote target means and a second remote target means, said first target means associated with said first cord and said second remote target means associated with said second cord, each remote target means of said first and second remote target means circumscribing a first preselected target area and a second preselected target area, respectively;

a first holding means for holding a free end of said first cord at a preselected location within said first preselected target area circumscribed by said first remote target means;

a second holding means for holding a free end of said second cord at a preselected location within said second preselected target area circumscribed by said second remote target means;

whereby a golfer may practice chip shots by positioning a preselected ball within said first or second preselected target area and hitting said preselected ball toward said base member along a path of travel denoted by said first or second cord, respectively;

whereby a golfer may alternatively practice chip shots by positioning said preselected ball near said base member and hitting said preselected ball toward said first or second preselected target area along a path of travel denoted by said first or second cord, respectively.

2. The apparatus of claim 1, wherein said mounting means includes an upright stake member secured to said base member, said upright stake member being driven into a ground surface a preselected distance to secure said base member to a ground surface.

3. The apparatus of claim 1, wherein said mounting means includes a central aperture formed in said base means and an upright stake member mounted in said central aperture, said upright stake member being driven into a ground surface a preselected distance to secure said base member to a ground surface.

4. The apparatus of claim 1, wherein said first remote target means and said second remote target means respectively include a flat, flexible material of circular configuration.

5. The apparatus of claim 4, wherein said flat, flexible material is covered on at least one side thereof with artificial turf.

6. The apparatus of claim 1, wherein said first and second holding means respectively include a first stake member and a second stake member driven into a ground surface at respective preselected locations within said first and second preselected areas, and wherein said first and second holding means further respectively include a first and second hook means for detachably engaging said first and second stake members, said first and second hook means being respectively secured to free ends of said first and second cord means.

7. The apparatus of claim 1, wherein said base member is flat, and further comprising a first eye hook member depending from said base member at a first end thereof and a second eye hook member depending from said base member at a second end thereof, said first eye hook member serving as a guide means for said first cord and said second eye hook member serving as a guide means for said second cord when said first and second cords are unwound from or wound onto said first and second reel means, respectively.

8. The apparatus of claim 1, wherein said base member is substantially flat, wherein a ninety degree bend is formed in said base member near each opposite end thereof to form a bent part at each opposite end, and wherein each bent part is centrally apertured to serve as a guide means for said first or second cord when a said first or second cord is unwound from or wound onto its said first or second reel means.

* * * * *